United States Patent [19]

Palovaara

[11] 4,429,819

[45] Feb. 7, 1984

[54] APPARATUS FOR LEADING THE TAIL OF WEB OF PAPER

[75] Inventor: Jaakko Palovaara, Muurame, Finland

[73] Assignee: Valmet Oy, Finland

[21] Appl. No.: 297,350

[22] Filed: Aug. 28, 1981

[30] Foreign Application Priority Data

Sep. 3, 1980 [FI] Finland ..... 802772

[51] Int. Cl.[3] ..... B65H 17/28

[52] U.S. Cl. ..... 226/95; 226/91; 226/97

[58] Field of Search ..... 226/95, 97, 7, 91, 92; 34/151, 152; 474/74, 226

[56] References Cited

U.S. PATENT DOCUMENTS

| | | | |
|---|---|---|---|
| 66,111 | 6/1867 | White | 474/266 X |
| 2,034,694 | 3/1936 | Dausmann | 226/95 X |
| 3,066,882 | 12/1962 | Havens et al. | 226/7 X |
| 3,425,610 | 2/1969 | Stewart | 226/95 |

FOREIGN PATENT DOCUMENTS

| | | | |
|---|---|---|---|
| 2746174 | 4/1979 | Fed. Rep. of Germany | 226/95 |
| 50-1581 | 6/1975 | Japan | 226/95 |

*Primary Examiner*—John M. Jillions

*Attorney, Agent, or Firm*—Steinberg & Raskin

[57] ABSTRACT

One or several fabric loops are disposed along the running route of a web of paper. The loops are driven via reversing rollers normally belonging to the paper machine. Air blowers extending along the running route of the fabric loops are disposed so that air jets blown through them support the tail of the web of paper and press it toward the fabric that drives the tail forward in connection with different parts of the machine, such as the calender and other rollers. An additional roller is provided as a continuation of the reversing roller and is provided with a magnetic clutch for connecting and disconnecting it as needed.

1 Claim, 3 Drawing Figures

APPARATUS FOR LEADING THE TAIL OF WEB OF PAPER

BACKGROUND OF THE INVENTION

The present invention relates to apparatus for leading the tail of a web of paper. More particularly, the invention relates to apparatus for guiding the tail of the web of paper before the widening of said web in connection with different parts of a paper machine, such as the calender, size press, dewatering press, smoothing press or other similar parts.

The DURAND TM tail carrier system of the prior art comprises a belt carrier and an incorporated suction box producing a suction effect by means of which the tail is adhered to the transfer belt. A disadvantage of this known apparatus is the fact that the transfer belts require their own reversing rollers and driving systems, and the placing of these into already cramped spaces causes problems. In addition, these apparatuses consume relatively much suction air and energy due to the suction boxes.

The operation of the AIRLIFT TM carrier system of the prior art is based on the Coanda effect. This apparatus comprises a nozzle orifice and a carrier surface connected thereto, along which air is blown at a relatively high speed. This creates an air cushion of reduced pressure, having a previously known carrying effect. A disadvantage of this apparatus is that it consumes much blowing air and thereby much energy. In addition, a disadvantage may be considered the fact that the blowing air tends to get packed into the nips through which the tail of the web is carried. This results in difficulties in getting the tail of the web to pass the nip. The packed air is guided aside and light paper is carried by the air current.

SUMMARY OF THE INVENTION

The principal object of the invention is to provide apparatus of simple structure and reliable operation, which is handled with facility and convenience, for leading the tail of the web of paper in connection with parts of a paper machine in which rope carrier systems known in the art have generally been used before.

An object of the invention is to provide apparatus for leading the tail of a web of paper, which apparatus may be used where the web of paper is still relatively wet, and therefore of relatively low strength, due to the efficient supporting effect of said apparatus.

Another object of the invention is to provide apparatus for leading the tail of a web of paper, which apparatus is suitable for use in all situations where a rope carrier system, or suction and blowing carrier apparatus have previously been used, including both sides of a machine stack of a paper machine, size presses, presses and transfer from the press section to the drying section.

Still another object of the invention is to provide apparatus for leading the tail of a web of paper, in which apparatus the tail is guided in a less disturbed manner into a nip and through it, because air is not packed in front of the nip in operation of the apparatus.

Yet another object of the invention is to provide apparatus for leading the tail of a web of paper, which apparatus transfers the tail of the web into a reel-up in a stable manner due to the lack of necessity for a strong tangential air current.

Another object of the invention is to provide apparatus for leading the tail of a web of paper, which apparatus consumes less air, and thus less energy, than apparatus of the prior art, because the air is required only to support the tail of the web via air jets, and not to transport the tail.

Still another object of the invention is to provide apparatus for leading the tail of a web of paper, which apparatus utilizes fabric loops which do not require their own driving systems due to the utilization of adjustable speed reversing rollers of the paper machine.

In order to avoid the disadvantages apparent from the aforedescribed prior art and to achieve the aforedescribed objects, the leading apparatus of the invention comprises one or several fabric loops that derive their driving power from a reversing roller normally belonging to the paper machine. Air blowing devices are provided adjacent a specific running section of the fabric at a suitable distance for directing air jets against the tail of the web to carry it so that said tail is supported and driven by said fabric and thereby transferred further.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 2:
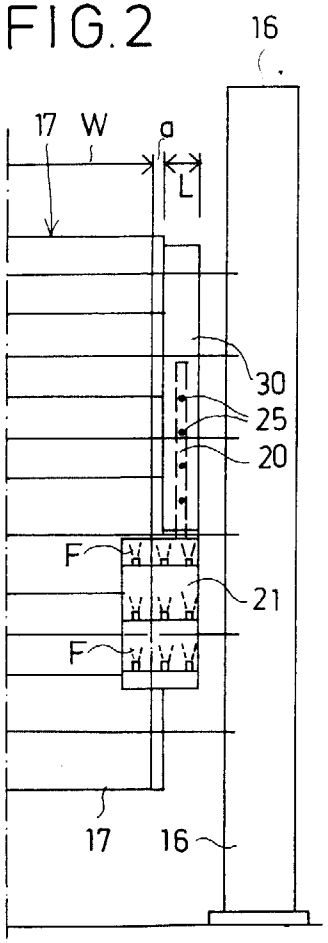
FIG. 2 is a view, taken along the lines II—II, of FIG. 1.
Figure 1:
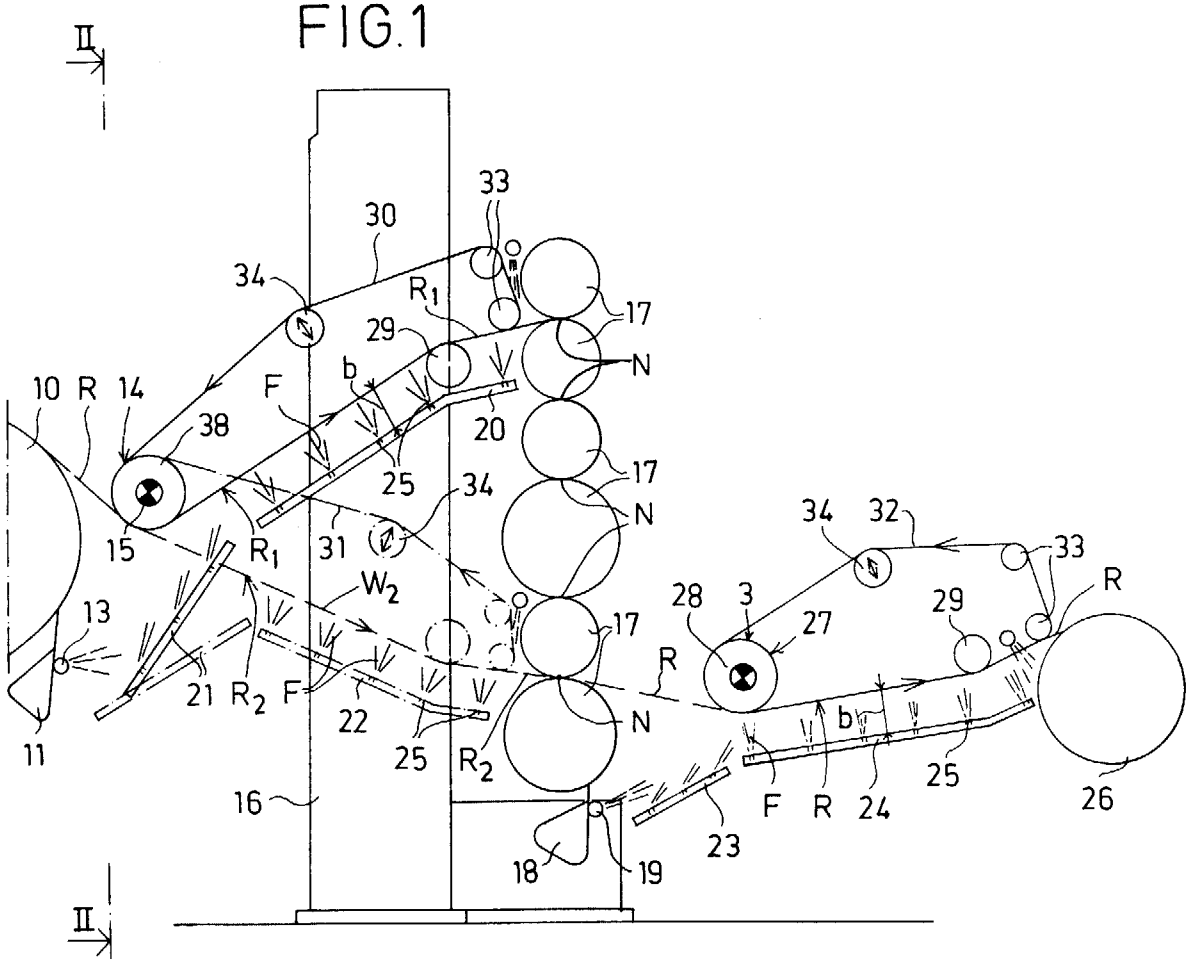
FIG. 1 is a schematic side elevation of a machine stack of a paper machine provided with the apparatus of the invention for leading the tail of the web, leading the edge of the tail into the top or the bottom nip.

As shown in FIG. 1, the narrow edge tail R of the web of paper is transferred from a last drying cylinder 10 into the first nip N of the calender and from the last nip N of said calender to a reel-up 26. The drying cylinder 10, or equivalent, is provided with a doctor 11 and blowing devices 13. In FIGS. 1 and 2, the calender is shown schematically and is previously known as such, comprising a body 16, into which is suspended the calender stack formed by the calender rollers 17. The lowest calender roller 17 is provided with a doctor 18 and a blower 19 guiding the tail R. After the drying cylinder 10, usual apparatus are provided for guiding the web to the first nip of the calendar. In particular, positioned below the path of the web are blowing devices 21, previously known as such, whereby the tail R of the web is supported and guided upwards towards the reversing roller 14 constituting part of the normal guiding devices of the web W from said cylinder to the first nip of the calendar. Thus, the web guiding apparatus includes a reversing roller 14 provided with a driving system 15 and a guide roller 29. Correspondingly, the web W is guided after the widening of the tail R from the last nip N of the calender to the reel-up 26 by the reversing roller 27 provided with a driving system 28 and a guide roller 29.

In accordance with the invention, a fabric loop 30 is provided for leading the tail R from the cylinder 10 into the first top nip N of the calender. The fabric loop 30 has a width L of, for example, about 250 mm, and is provided at a distance a of, for example, about 50 mm from the edge of the web W. The fabric loop 30 is guided by rollers 33. Additionally, a tightening roller 34 is positioned inside the fabric loop 30. Correspondingly, the apparatus between the bottom nip N of the calender and the reel-up 26 comprises a fabric loop 32, in accordance with the invention, running around the reversing roller 27 of the paper machine, the leading guide roller 29, the guide rollers 33 and the tightening roller 34, along the path shown in FIG. 1. In FIG. 1, a dotted broken line additionally indicates a fabric loop 31 which runs around the reversing roller 14 of the paper machine and leads the tail of web directly along the path $R_2$ into the bottom nip of the calender. The tail leading paths $R_1$ and $R_2$ are alternative.

In accordance with the invention, elongated blowers 20, 22 and 24 extend along the running direction of the fabrics adjacent the lower running section of the fabric loops 30, 31 and 32, respectively. The blowers 20, 22 and 24 are positioned a suitable distance b from the fabric loops 30, 31 and 32, respectively, and have several successive nozzle openings 25 in their sides facing said fabrics. The nozzle openings are preferably parallel. The openings 25 produce a supporting effect, directed towards the fabrics 30, 31 and 32, via air jets F, against the tail R of the web. The tail R is thus pressed reliably and adheres to the fabrics 30, 31 and 32 during transfer. The fabrics 30, 31 and 32 are driven by the normal reversing rollers 14 and 27 of the paper machine, so that the speed of said fabrics is adjusted, without any particular additional arrangements or devices, according to the speed of the paper machine by using the speed adjustment devices of the paper machine as such. This is an essential advantage.

In accordance with the invention, the fabric loops 30, 31 and 32 carry the tail R of the web forward, and the air jets F are only used to support said tail and keep it in contact with the fabric of said fabric loops. Thus, the volume of air discharging as jets F remains relatively low and, in any case, essentially lower than in the known corresponding apparatus, in which the transporting of the tail is based primarily on the use of air jets.

Figure 3:
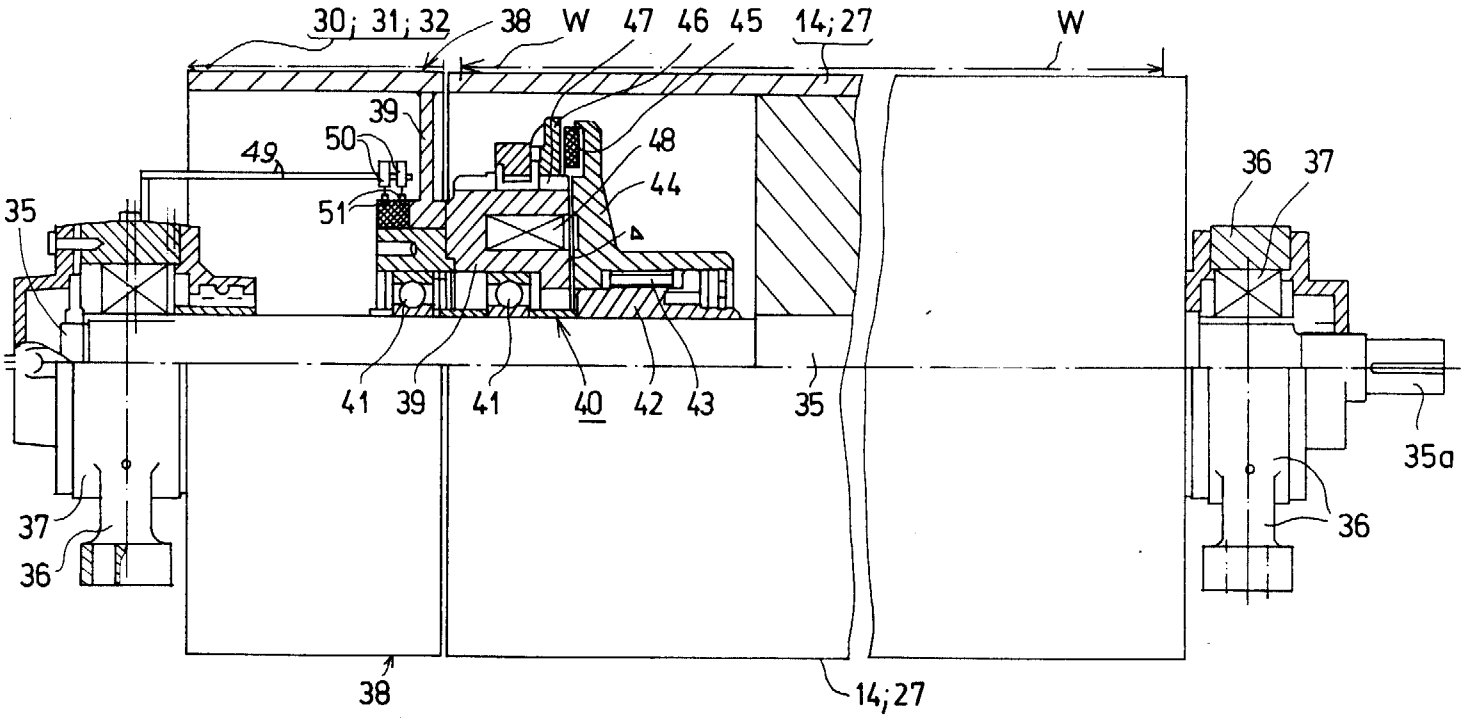
FIG. 3 is a view, on an enlarged scale, partly cut away and partly in section, of an embodiment of a guide roller of paper provided with a particular additional wheel, used in reducing the apparatus of the invention to practice.

As shown in FIG. 3, each of the normal reversing rollers 14 and 27 of the paper machine is provided with an axle 35. The axle 35 is driven via a gudgeon 35*a* by known driving apparatus. The axle 35 is mounted on bearings 37 and bearing supports 36. In a preferred embodiment of the invention, an additional roller 38, having the same diameter as the reversing rollers 14 and 27, is mounted as a continuation of the normal mantle of said rollers, guiding a normal-width web W of paper. The roller 38 drives the fabric loops 30, 31 and 32. The roller 38 is mounted on the axle 35 via its hub 39 and bearings 41.

A known magnetic clutch 40 is affixed to the hub 39. The magnetic clutch 40 comprises a socket part 42 immovably affixed to the axle 35. The socket part 42 is coupled via a gear 43 to a clutch flange 44, which thus firmly rotates with the axle 35 and the reversing roller 14 or 27. A clutch disc 45 is firmly affixed to the clutch flange 44. On the other side, the clutch 40 comprises parts affixed to the hub 39 of the roller 38 so that the other half 46 of said clutch is coupled to said hub via a gear 47 around said hub.

The hub 39 has an electromagnetic coil 48 having an iron magnetic core. The magnetic flux produced in the iron magnetic core of the coil 48 is conveyed by air foils Δ to the iron parts of the opposite half of the clutch 40. Electrical contacts, or commutators, 51 are affixed to the hub 39. Electric power, required by the coil 48, is fed to the contacts 51 via electric brushes 50 and electric wire 49.

When electric power is fed to the coil 48, the clutch halves 46 and 45 are drawn towards each other due to magnetic attraction prevelant in the air foil Δ, and the clutch 40 is closed. When the clutch 40 is closed, the roller 38 rotates, and the fabric loops 30, 31 and 32 guided by said roller rotate with the reversing roller 14 or 27, for example, when leading the tail R of the web via the apparatus. When the tail R has been widened, the clutch 40 is opened and the roller 38 and the fabric loops 30, 31 and 32 guided by it remain stationary and idle.

The width of the fabric loops 30, 31 and 32 is greater than the width of the tail R of the web W.

The fabric of the fabric loops 30, 31 and 32 preferably consists of wire cloth.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense, It is also to be understood that the following claims are intended to cover all of the generic and specific features of the invention herein described, and all statements of the scope of the invention which, as a matter of language, might be said to fall therebetween.

What is claimed is:

1. Apparatus for leading the tail of a web of paper forward, before widening of said web, to cooperate with different parts of a paper machine, said paper machine including an axle and a reversing roller mounted on said axle and having a predetermined diameter, said apparatus comprising a fabric loop driven by said reversing roller, said fabric loop having a specific running section;

an air blower positioned at a distance from said fabric loop adjacent said specific running section thereof, said air blower having jet means for directing a plurality of air jets toward said tail of said web whereby said tail is supported by said fabric loop and transferred forward thereby;

an additional roller mounted on said axle and having a diameter equal to that of said reversing roller, said additional roller guiding said fabric loop; and a clutch in operative engagement between said reversing roller and said additional roller for driving said additional roller and said fabric loop at the operating speed of said paper machine when said clutch is closed, and for permitting said additional roller and said fabric loop to remain idle when said clutch is open.

* * * * *